US005841341A

United States Patent [19]

West

[11] Patent Number: 5,841,341

[45] Date of Patent: Nov. 24, 1998

[54] CLIP FOR PTC DEVICES

[75] Inventor: Jeffrey A. West, Bellville, Ohio

[73] Assignee: Therm-O-Disc, Incorporated, Mansfield, Ohio

[21] Appl. No.: 702,381

[22] Filed: Sep. 27, 1996

[51] Int. Cl.[6] ..... H01R 37/38

[52] U.S. Cl. ..... 338/321; 361/736; 361/752; 338/22 R; 338/22 SD; 338/315; 338/232

[58] Field of Search ..... 338/22 R, 22 SD, 338/25, 232, 276, 315, 321; 200/303; 361/736, 752

[56] References Cited

U.S. PATENT DOCUMENTS

| | | | |
|---|---|---|---|
| 3,955,170 | 5/1976 | Geishecker | 338/22 SD |
| 4,029,896 | 6/1977 | Skinner | 174/138 F |
| 4,267,635 | 5/1981 | Blaha | 29/622 |
| 4,362,904 | 12/1982 | Schneider et al. | 74/138 G |
| 4,791,531 | 12/1988 | Jessup | 12/198 |
| 4,795,857 | 1/1989 | McInnis | 174/138 F |
| 5,142,265 | 8/1992 | Motoyoshi et al. | 338/22 R |
| 5,227,958 | 7/1993 | Glomski et al. | 361/752 |
| 5,268,665 | 12/1993 | Iwao | 338/22 R |
| 5,469,332 | 11/1995 | Alvite | 361/736 |

FOREIGN PATENT DOCUMENTS

| | | | |
|---|---|---|---|
| 252720 | 12/1987 | Germany | 361/736 |
| 1-208803 | 8/1989 | Japan | 338/22 R |
| 2201000 | 8/1988 | United Kingdom | 361/736 |

*Primary Examiner*—Michael L. Gellner
*Assistant Examiner*—Karl Easthom
*Attorney, Agent, or Firm*—Jones,Day,Reavis & Pogue

[57] ABSTRACT

A dielectric clip for holding a PTC device is dimensioned and shaped to occupy a three-dimensional space envelope that provides a close fit in a fuse socket.

26 Claims, 8 Drawing Sheets

CLIP FOR PTC DEVICES

BACKGROUND OF THE INVENTION

This application relates to the art of thermal protectors and, more particularly, to thermal protectors for limiting electrical current in response to an elevated temperature. The invention will be described with reference to a thermal protector of the type having a polymeric compound that includes carbon particles and has a positive temperature coefficient of resistance. Under normal operating conditions the resistance is very low and jumps sharply to effectively block current flow at a predetermined elevated temperature. It will be appreciated that other types of thermal protectors and PTC materials can be used in accordance with the present application.

Replacing a conventional fuse with a PTC devices requires a holder for the PTC device that will fit within the same socket as the fuse. It would be desirable to have a simple way of providing such a holder for a PTC device.

SUMMARY OF THE INVENTION

A dielectric clip for holding a PTC device enables the PTC device to be received within the same socket as a conventional fuse.

In accordance with one arrangement, the clip grips top and bottom ends of a PTC device with the terminals of the PTC device projecting from the clip. The clip has an external envelope that is dimensioned and shaped for close reception in a conventional fuse socket.

In accordance with another aspect of the invention, the clip has a central bottom projection with an upwardly facing pocket receiving a bottom end of a PTC device. Terminals on the PTC device extend closely past opposite sides of the bottom projection for reception in female terminals of a fuse socket.

In accordance with another aspect of the application, the bottom projection on the clip has an externally tapered terminal end portion to facilitate insertion of the clip within a conventional fuse socket.

The clip bottom projection has a pocket forming wall with an outer cam surface to facilitate snapping of the bottom or terminal end of a PTC device into the clip.

A top projection on one clip embodiment includes a downwardly facing top pocket for receiving the top end portion of a PTC device. Front and rear enlargements at the top end of the clip increase the clip thickness for close reception in a fuse socket.

A PTC device received in the clip has tabs extending outwardly from the lower corners thereof to facilitate guiding movement of the clip and PTC device assembly into a fuse socket.

In accordance with another aspect of the application, a clip for holding a PTC device comprises an assembly of two identical dielectric housing parts in which the entire PTC device is completely enclosed except for its terminals. The housing has a latch finger adjacent the bottom thereof for receiving a top end portion on a reversely positioned cooperating housing part.

It is a principal object of the present invention to provide a dielectric clip or housing for holding a PTC device.

It is also an object of the invention to provide such a clip or housing that is relatively simple to manufacture and assemble.

It is another object of the invention to provide such a clip or housing that is receivable in a fuse socket.

DESCRIPTION OF PREFERRED EMBODIMENTS

Figure 1:
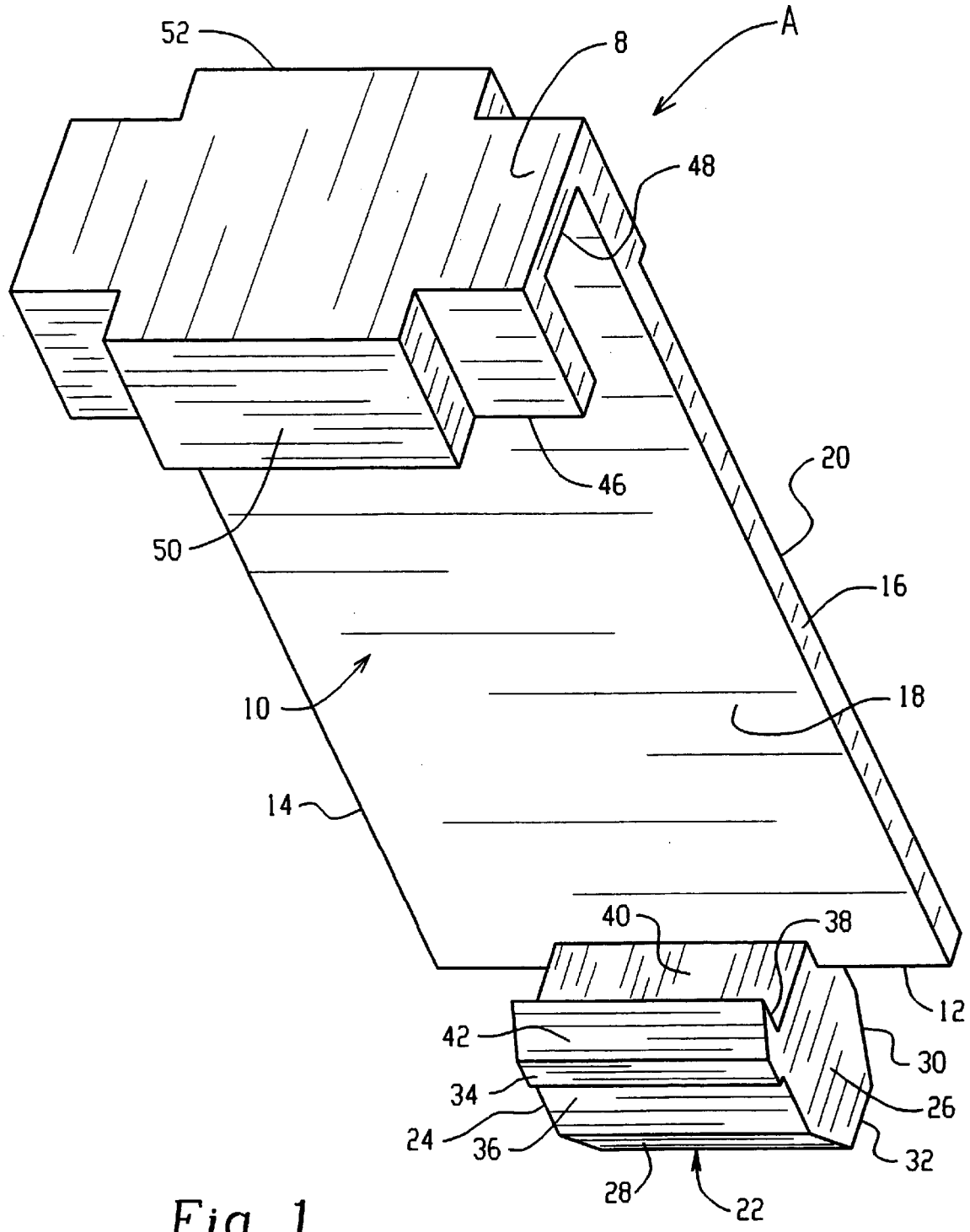
FIG. 1 is a perspective illustration of a clip constructed in accordance with the present application.
Figure 3:
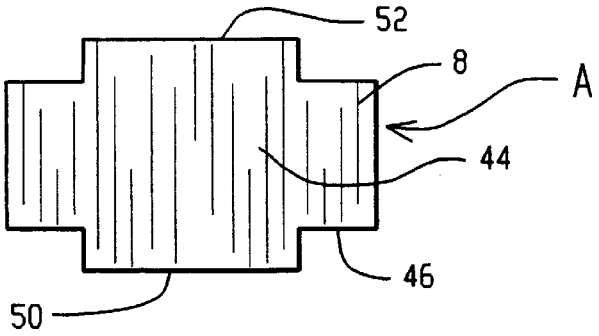
FIG. 3 is a top plan view thereof.
Figure 2:
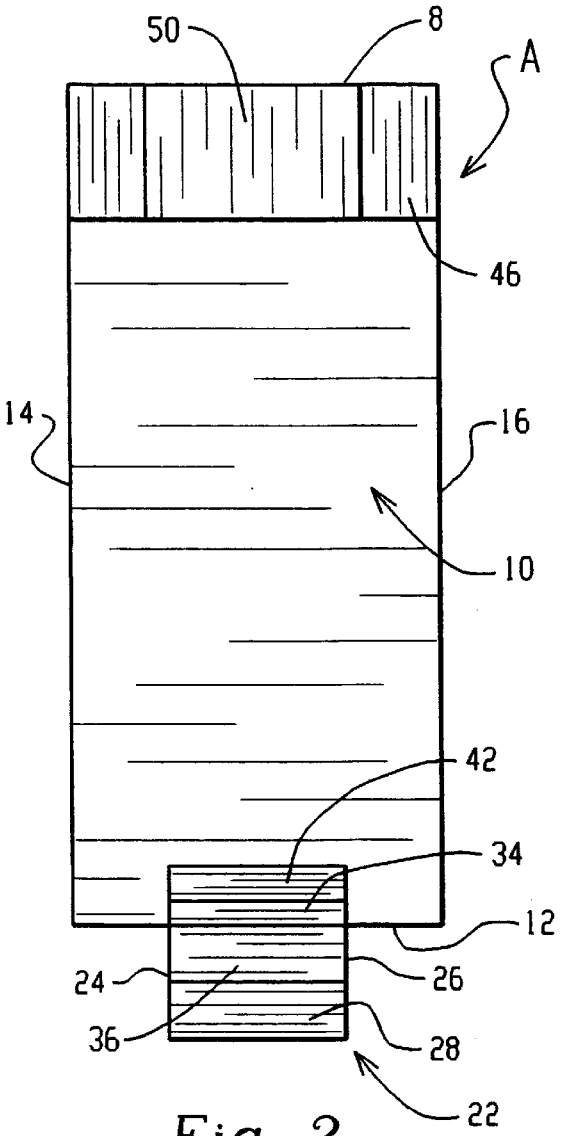
FIG. 2 is a front elevational view thereof.
Figure 4:
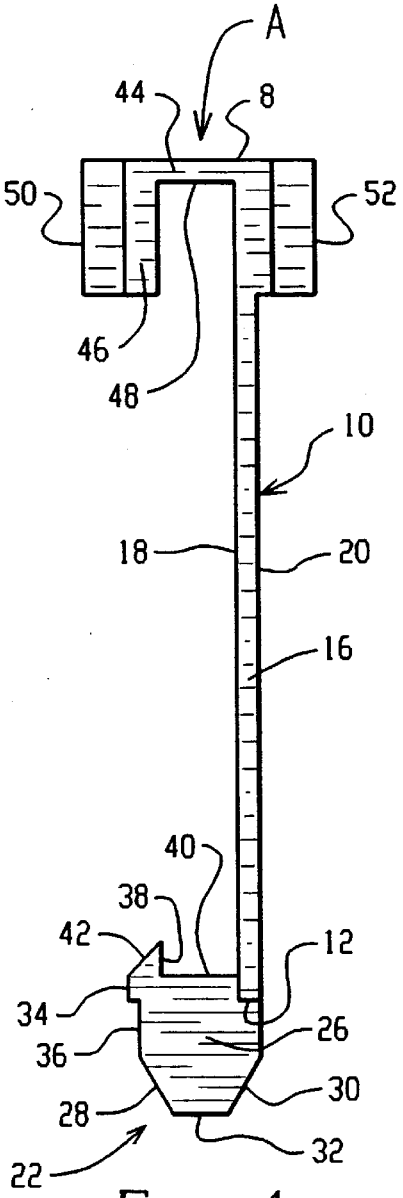
FIG. 4 is a side elevational view thereof.

Referring now to the drawing, wherein the showings are for purposes of illustrating certain preferred embodiments of the invention only and not for purposes of limiting same, FIG. 1 shows a dielectric clip A molded in one piece of plastic material and having a substantially flat rectangular base 10 with top and bottom ends 8, 12, opposite sides 14, 16, and front and rear faces 18, 20.

A central bottom projection 22 extends outwardly from bottom end 12 and front face 18. Bottom projection 22 has opposite bottom projection sides 24, 26 spaced inwardly from sides 14, 16 of base 10. The width of bottom projection 22 between opposite bottom projection sides 24, 26 is not greater than one-half of the width of base 10 measured across opposite sides 14, 16. Projection 22 has a terminal end portion that includes tapered front and rear cam surfaces 28, 30 that slope toward one another in a direction toward terminal end 32 to facilitate insertion of the clip in a fuse socket.

An extension 34 projects outwardly from the upper end portion of front face 36 on bottom projection 22. A pocket forming wall 38 extends upwardly above extension 34 in outwardly-spaced relationship to front face 18 of base 10 to define a bottom pocket 40 that opens upwardly toward top end 8. Pocket forming wall 38 has an outer cam surface 42 that slopes from extension 34 toward front face 18 of base 10.

A top projection 44 extends outwardly away from front face 18 of base 10 adjacent top end 8 thereof. Top projection 44 includes a downwardly extending portion 46 spaced outwardly from front face 18 to define a downwardly facing pocket 48 aligned with bottom pocket 40. Top and bottom pockets 48, 40 have the same width in a direction outwardly from front face 18 of base 10 and are integral with base 10.

Top front and rear rectangular enlargements 50, 52 extend outwardly adjacent top end 8 of the clip. Enlargements 50, 52 have approximately the same width and are slightly wider than the width of bottom projection 22 measured across opposite bottom projection sides 24, 26.

Figure 5:
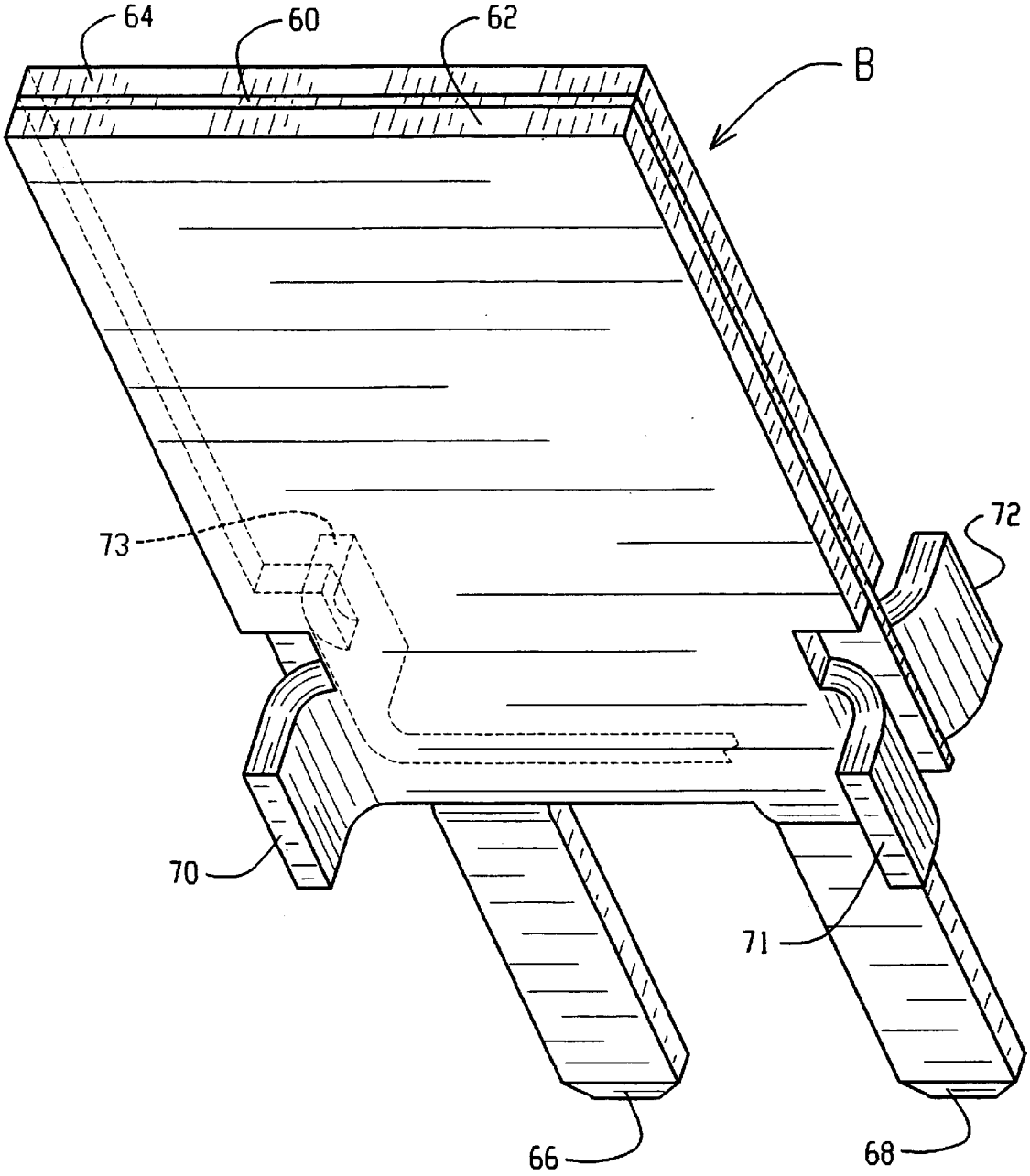
FIG. 5 is a perspective illustration of a PTC device used with the clip of FIGS. 1–4.
Figure 7:
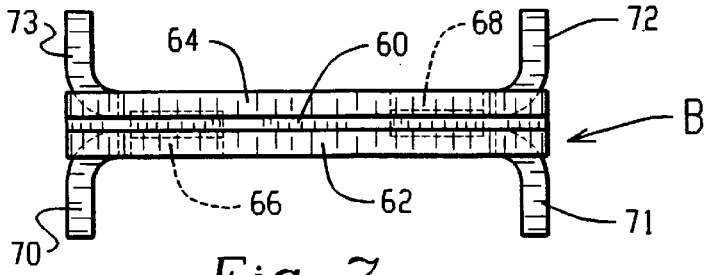
FIG. 7 is a top plan view thereof.
Figure 6:
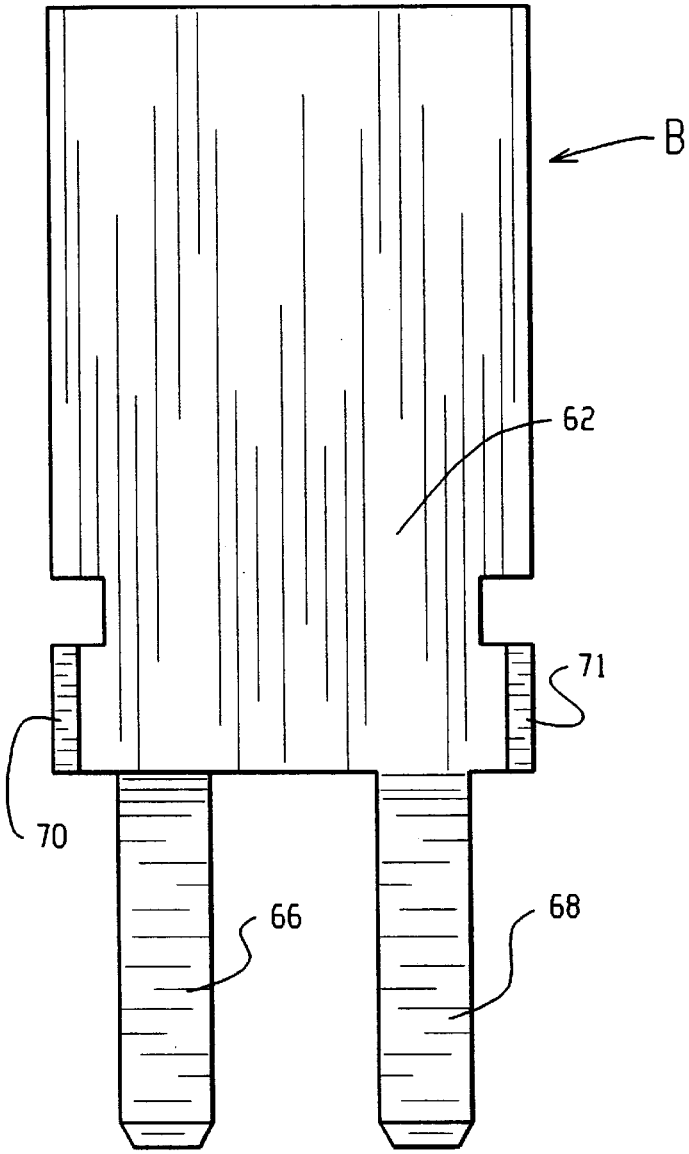
FIG. 6 is a front elevational view thereof.

FIG. 5 shows a PTC device having a central layer of PTC material 60 sandwiched between a pair of metal terminal plates 62, 64. A pair of spaced-apart terminals 66, 68 extend outwardly from the bottom end of PTC device B with one terminal 68 being on plate 62 and the other terminal 66 being on plate 64. The lower corners of each plate are provided with tabs 70–73 extending outwardly therefrom substantially perpendicular to plates 62, 64. Tabs 70–72 effectively increase the thickness of PTC device B at the end of PTC device B from which terminals 66, 68 project.

Figure 8:
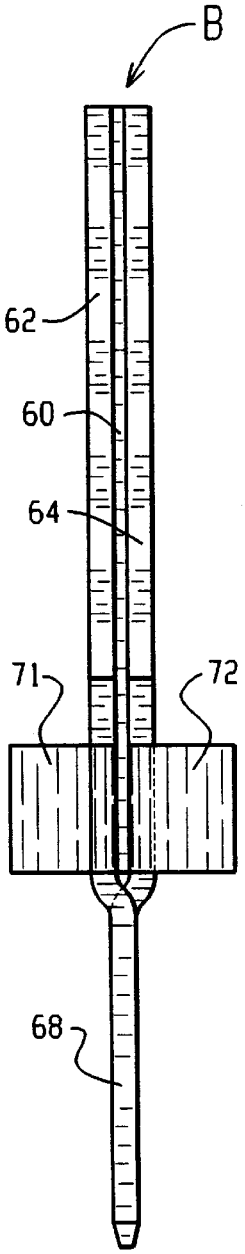
FIG. 8 is a side elevational view thereof.

As shown in FIG. 8, terminals 66, 68 are bent to be in alignment with one another along the center line of the thickness of PTC device B.

Figure 9:
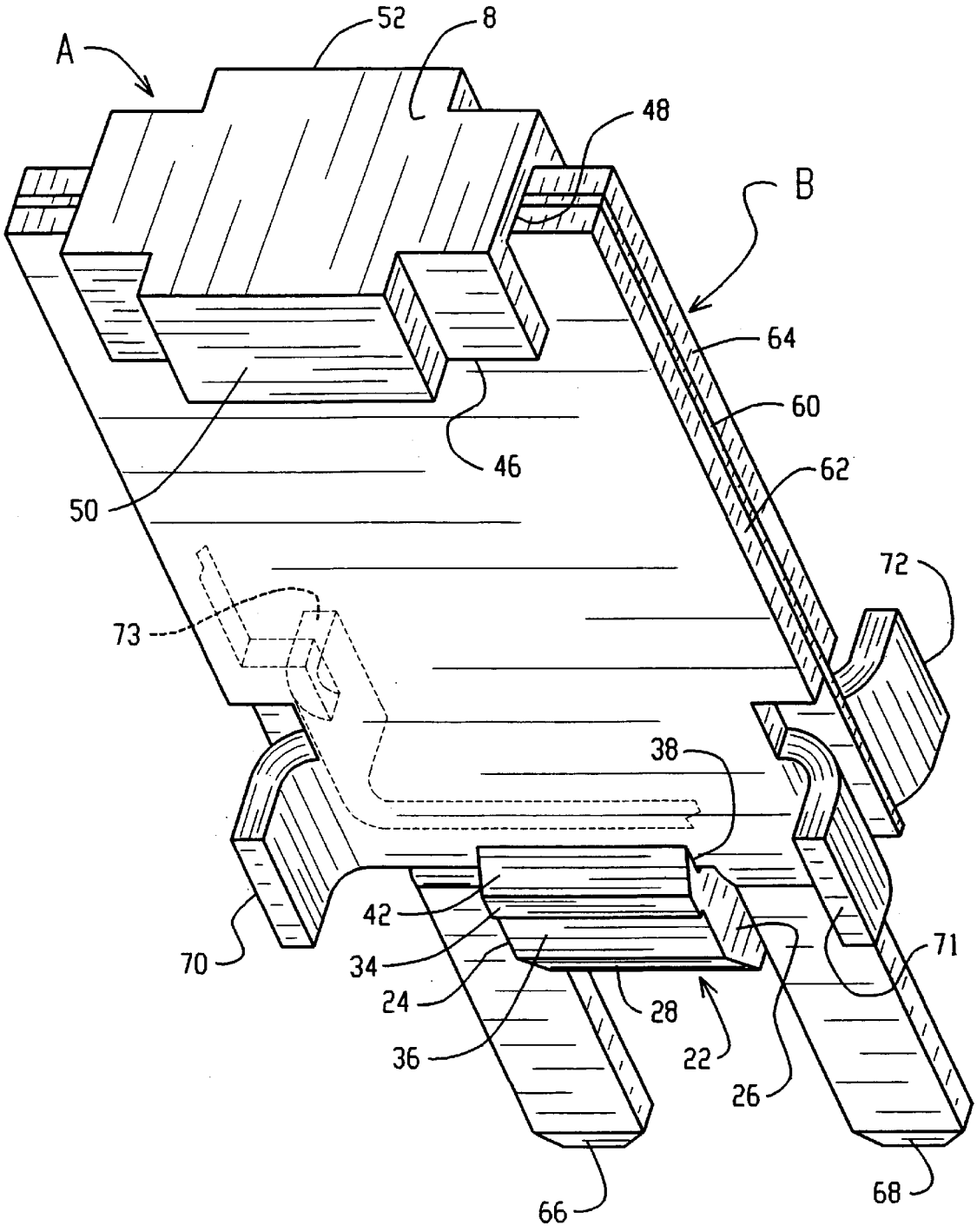
FIG. 9 is a perspective illustration showing the PTC device of FIGS. 5–8 received in the clip of FIGS. 1–4.

FIG. 9 shows PTC device B received in clip A. The assembly is made by inclining the clip and PTC device relative to one another while inserting the top end portion of PTC device B in top pocket 48. The PTC device and base portion 10 of clip A are then squeezed toward one another. Engagement of the bottom end portion of the PTC device with cam surface 42 on bottom projection 22 causes base portion 10 to bend rearwardly until the bottom end of the PTC device snaps past pocket defining wall 38 for close reception within pocket 40. The space between terminals 66, 68 on PTC device B is slightly greater than the width of bottom projection 22 as measured across opposite sides 24, 26 thereof. Thus, bottom projection 22 is closely received between terminals 66, 68.

The length of tabs 70–73 is such that the outer terminal ends of tabs 70, 71 lie in approximately the same front plane as the flat outer surface of front enlargement 50, while the outer terminal ends of tabs 72, 73 lie in approximately the same rear plane as the flat outer surface of top rear enlargement 52. Thus, guiding surfaces that lie in the same plane are provided adjacent both the top and bottom ends of the assembled device, and the front and rear planes are parallel.

Figure 10:
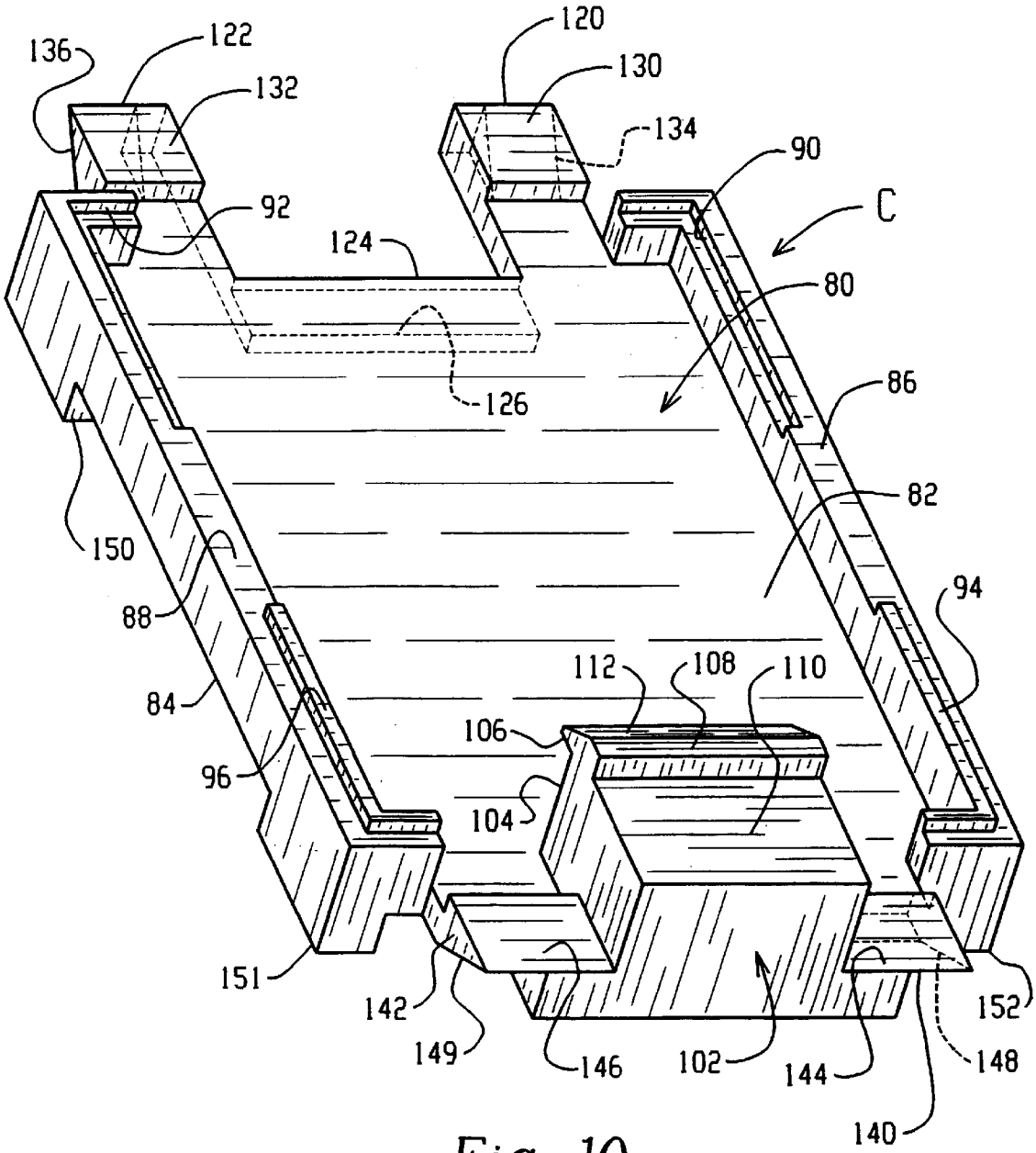
FIG. 10 is a perspective illustration of a dielectric housing part for another embodiment.

FIG. 10 shows a dielectric housing part C molded of plastic material and having a flat base portion 80 with internal and external faces 82, 84. Opposite side peripheral walls 86, 88 extend upwardly from internal face 82 to define a cavity within housing member C.

Side walls 86, 88 have substantially L-shaped rabbets 90, 92 therein and substantially L-shaped ribs 94, 96. The rabbets and ribs are dimensioned and shaped so that a rib is closely receivable in a rabbet.

A central bottom projection 102 extends outwardly from internal face 82 and has an upwardly facing pocket 104 therein. A latch finger 106 extends upwardly to define an outer wall for pocket 104 that is spaced outwardly from internal face 82. Latch finger 106 extends outwardly from an extension 108 at the upper end of bottom projection outer surface 110. An outer cam surface 112 on latch finger 106 slopes from extension 108 toward internal face 82.

Spaced-apart arms 120, 122 extend outwardly from the top of housing part C to define a space therebetween for closely receiving a bottom projection 102 on another housing part. A top end 124 of housing part 90 is receivable behind a latch finger 106 on another housing part. A recess 126 extends into external surface 84 adjacent top end 124 for receiving latch finger 106. Recess 126 provides top end 124 with a reduced thickness compared to the remainder of base portion 80.

Projections 120, 122 have upper surfaces 130, 132 that face in the same direction as internal surface 82 and are spaced slightly upwardly therefrom. The opposite surfaces of projections 120, 122 are tapered as indicated at 134, 136 to facilitate insertion of assembled housing parts within a fuse socket.

Projections 140, 142 on opposite sides of bottom projection 102 have surfaces 144, 146 that are spaced outwardly from internal face 82 of base 80 and lie in a common plane with surfaces 130, 132 on projections 120, 122. Projections 140, 142 have external tapered surfaces 148, 149 to facilitate insertion of an assembled device into a fuse socket. Housing part C has corner spacers or legs 150–153 extending outwardly from external surface 84.

Figure 11:
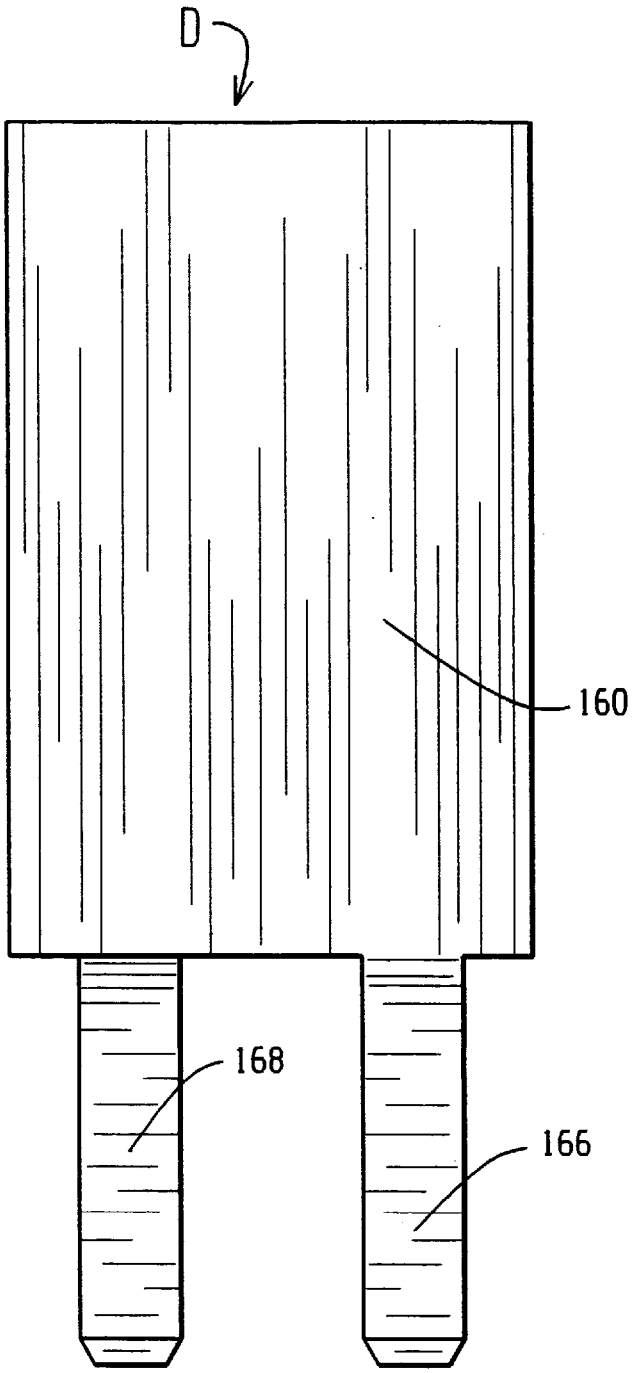
FIG. 11 is a front elevational view of a PTC device used with the housing part of FIG. 10.
Figure 12:
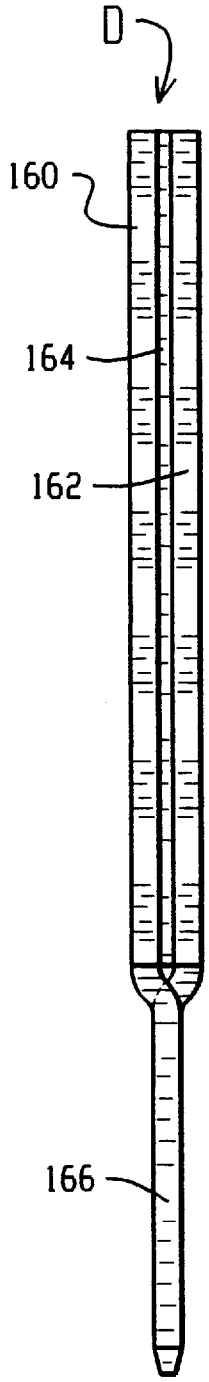
FIG. 12 is a side elevational view thereof.

FIGS. 11 and 12 show a PTC device D for assembly with a pair of housing parts C of FIG. 10. PTC device D includes a pair of outer metal terminal plates 160, 162 with a thin layer of PTC material 164 sandwiched therebetween. Terminal plate 160 has a terminal leg 166 extending outwardly from the bottom end thereof and terminal plate 162 has a corresponding terminal leg 168. Terminal legs 166, 168 are bent inwardly of their corresponding plates adjacent the bottom end of PTC device D so that the legs are aligned with one another and centered on the thickness of the PTC device as shown in FIG. 12.

Figure 13:
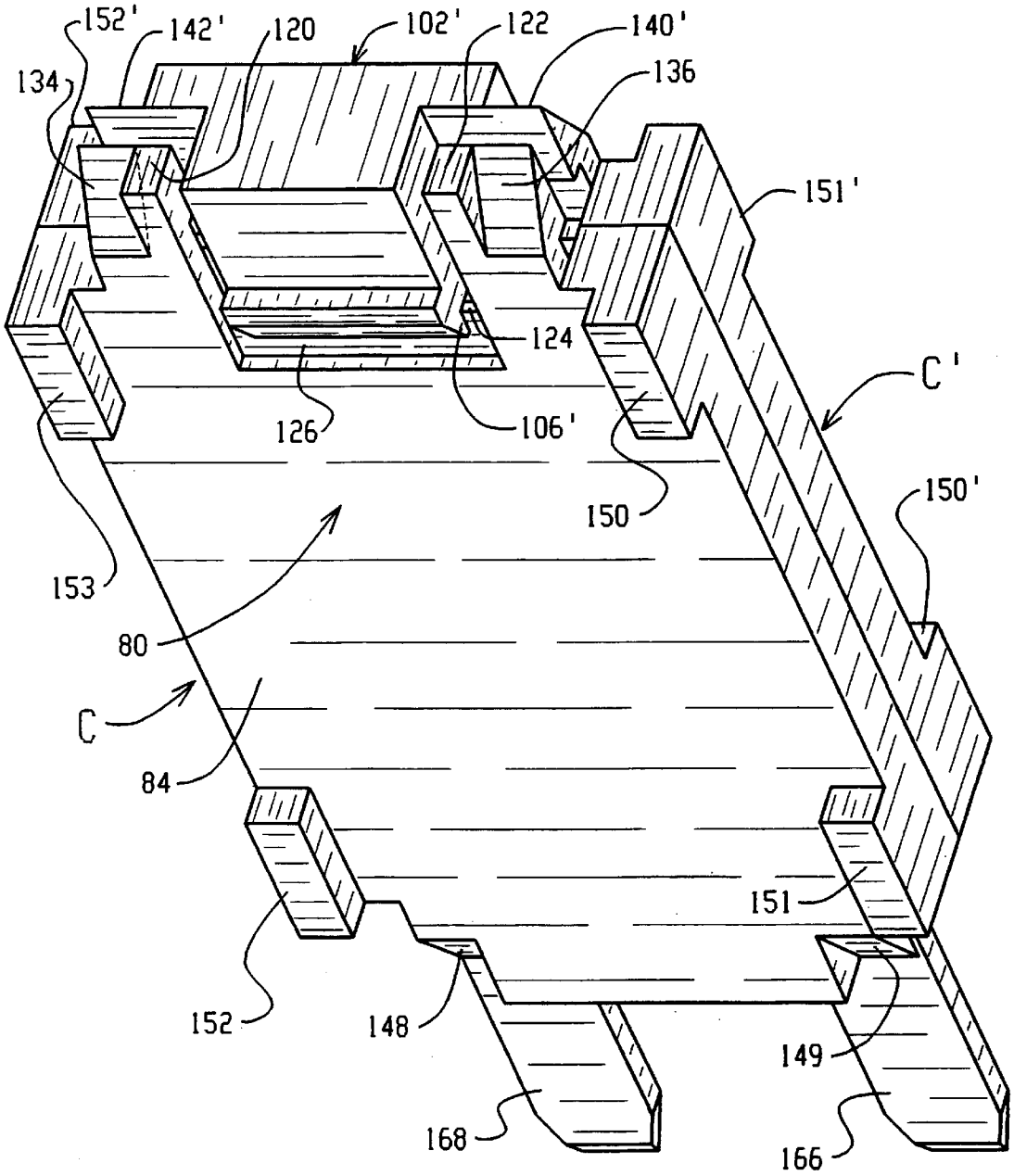
FIG. 13 is a perspective illustration showing two housing parts of FIG. 10 reversely positioned end-for-end and snapped together with the PTC device of FIGS. 11 and 12 enclosed therebetween.

FIG. 13 shows a pair of housing parts enclosing a PTC device. The other duplicate housing part has been identified by prime numbers corresponding to the numbers used for housing part C. A PTC device D of FIGS. 11 and 12 is positioned with its top end portion received in pocket 104 on bottom projection 102 and with its terminals 166, 168 extending across surfaces 130, 132 on projections 120, 122. Another housing part is then reversely positioned and snapped together with the mating housing part as the L-shaped ribs 94, 96 on one housing part are received in the L-shaped rabbets 90, 92 on the other housing part. The outer cam surface 112 on a bottom projection 102 of each housing part engages top end 124 on the other housing part. Squeezing the housing parts together then allows top ends 124 to snap behind latch fingers 106 on the two housing parts with the PTC device closely received in the cavity defined between the two housing parts.

Terminal guide surfaces 130, 132 and 144, 146 are spaced outwardly from internal face 82 a distance that is approximately the same as the distance from the outer surface of a metal plate 160 or 162 to the outer surface of a terminal 166 or 168. When two housing parts are snapped together end-for-end, terminal guide surfaces 130, 132 on one housing part are spaced from terminal guide surfaces 144, 146 on the other housing part a distance that is approximately the same as the thickness of a terminal 166 or 168. Thus, the outer surfaces of sidewalls 86, 88 are spaced outwardly from terminal guide surfaces 130, 132, 144 and 146 a distance that is approximately one-half the thickness of a terminal 166 or 168.

In the present application, the PTC material is a polymeric compound containing carbon particles and having a positive temperature coefficient of resistance. The PTC material has a very low resistance at normal operating temperatures and an extremely high resistance above a predetermined switching temperature. The PTC material may reach its switching temperature by self-induced $I^2R$ heating or by exposure to an elevated temperature in the surrounding environment. The PTC material automatically switches to its high resistance state at the switching temperature and effectively blocks current flow to an electrical apparatus that is protected by the PTC device. Metal foil electrodes (not shown) are bonded to both of the opposite faces of the PTC material and are coextensive in area with the PTC material. The metal terminal plates are soldered to the foil electrodes.

The PTC material has a thickness that is preferably less than 0.05 inch and usually less than 0.02 inch. The PTC material has a switching temperature that is not less than 80° C., although it will be appreciated that the switching temperature can be much higher than 80° C. At the switching temperature, the resistivity and the resistance of the PTC device and the PTC material jumps at least several orders of magnitude. That is, the resistivity and the resistance jumps at the switching temperature to at least $10^3$ times the resistivity and the resistance of the PTC device and the PTC material at 25° C. By way of example, the resistivity of the PTC material at 25° C. is preferably not greater than 100 ohm-centimeters. At the switching temperature, the resistivity jumps to a value that is at least $10^3$ times the resistivity at 25° C. Between 25° C. and the switching temperature, the resistivity does not deviate significantly from its value at 25° C.

As shown in the drawing, bottom pocket 40, 104 in bottom projection 22, 102 has an entrance opening that opens in a direction toward top end 8, 124 and a bottom wall that faces in a direction toward top end 8, 124. The pocket bottom wall is spaced further away from top end 8, 124 by virtue of being on the opposite side of the pocket entrance opening from top end 8, 124. The pocket 40, 104 extends in a direction between opposite sides 14, 16, and 84, 86, and extends in a direction parallel to the bottom end of the base 10, 80 adjacent to which it is located. The bottom pocket forming wall 38, 106 extends upwardly from the pocket bottom wall in a direction toward top wall 8, 124. The pocket forming wall also is spaced in a direction outwardly from front face 18, 82, and extends substantially parallel to such front faces. The bottom wall of the bottom pocket extends outwardly away from front face 18, 82 to intersection with bottom pocket forming wall 38, 106. Bottom projection 22, 102 projects beyond the outer periphery of base 10, 80 in a direction away from top end 8, 124. Front face 18,82 is substantially flat and unobstructed between top end 8,124 of substantially flat base 10,80 and the bottom pocket 40,104 so that a substantially flat PTC device can lie closely against the front face.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. A one piece substantially rectangular nonmetallic dielectric clip for holding PTC devices, said clip having a substantially flat base with top and bottom ends and opposite sides, a central projection adjacent said bottom end and having a latch finger thereon, bottom guide projections extending outwardly from said base at said bottom end thereof on opposite sides of said central projection, top guide projections extending outwardly from said base at said top end thereof in alignment with said bottom guide projections, said guide projections having guide surfaces, a peripheral wall extending outwardly from said front face, said peripheral wall being interrupted along said guide projections and said central projection, said peripheral wall having a height outwardly from said front face and said guide surfaces being located outwardly from said front face intermediate said peripheral wall height, said clip being positionable with a corresponding clip to provide a housing defined by a pair of clips reversely positioned end-for-end with their peripheral walls abutting and their front faces opposed to one another in spaced relationship to define a housing cavity and with the top end on each clip received beneath the latch finger on the other clip and the guide surfaces on said bottom guide projections of one clip aligned with the guide surfaces on said top guide projections of the other clip in opposed spaced relationship to provide passages for electrical terminals on a PTC device.

2. The clip of claim 1 wherein said clip has four corners and a rear face, a spacer leg projecting outwardly from said rear face adjacent each of said corners, and said spacer legs having terminal ends lying in a common plane.

3. A one piece substantially rectangular nonmetallic dielectric clip for holding PTC devices, said clip having a substantially flat base with substantially flat front and rear faces, said base having an outer periphery defined by opposite sides and top and bottom ends that have a length shorter than said sides, said base having a base thickness between said front and rear faces, a bottom projection adjacent said bottom end and having opposite bottom projection sides spaced inwardly from said opposite sides of said base, said bottom projection having a thickness perpendicular to said front face that is substantially greater than said base thickness and having a bottom pocket therein adjacent said front face opening toward said top end of said base, said bottom projection having a pocket forming wall spaced outwardly from said front face and extending toward said top end, said pocket forming wall having an inner pocket wall surface facing toward said front face of said base and an outer pocket wall surface on the opposite side thereof from said front surface of said base, said pocket forming wall having a pocket forming wall end, said outer pocket wall surface including a sloping outer cam surface that slopes in directions toward said pocket forming wall end and toward said front face of said base, and said bottom projection extending beyond said outer periphery from said bottom end.

4. A one-piece substantially rectangular nonmetallic dielectric clip for holding PTC devices, said clip having a substantially flat base with substantially flat front and rear faces, said base having an outer periphery defined by opposite sides and top and bottom ends that have a length shorter than said sides, said base having a base thickness between said front and rear faces, a bottom projection adjacent said bottom end and having opposite bottom projection sides spaced inwardly from said opposite sides of said base, said bottom projection having a thickness perpendicular to said front face that is substantially greater than said base thickness and having a bottom pocket therein adjacent said front face opening toward said top end of said base, said bottom projection extending beyond said outer periphery from said bottom end, a top projection having a top pocket adjacent said front face opening toward and aligned with said bottom pocket, said top projection including a central substantially rectangular front enlargement extending away from said front face and a central substantially rectangular rear enlargement extending away from said rear face, and said front and rear enlargements being substantially aligned with one another on opposite sides of said base.

5. The clip of claim 4 wherein each of said front and rear enlargements has a width that is greater than the width of said bottom projection.

6. A circuit protector assembly comprising a one-piece substantially rectangular nonmetallic dielectric clip for holding PTC devices, said clip having a substantially flat base with substantially flat front and rear faces, said base having an outer periphery defined by opposite sides and top and bottom ends that have a length shorter than said sides, said base having a base thickness between said front and rear faces, a bottom projection adjacent said bottom end and having opposite bottom projection sides spaced inwardly from said opposite sides of said base, said bottom projection having a thickness perpendicular to said front face that is substantially greater than said base thickness and having a bottom pocket therein adjacent said front face opening toward said top end of said base, said bottom projection extending beyond said outer periphery from said bottom end, a PTC device that includes a PTC material sandwiched between a pair of metal terminal plates, a pair of spaced-apart elongated terminals extending from said plates at one end of said PTC device, said PTC device being positioned on said front face of said base with said one end of said PTC device received in said pocket and with said terminals extending closely past said opposite bottom projection sides, said terminal plates having corner portions adjacent said one end of said PTC device and said corner portions including tabs extending substantially perpendicular to said plates, said tabs having tab ends spaced outwardly from said front and rear faces of said base, front and rear enlargements extending outwardly from said front and rear faces adjacent said top end of said base, and said enlargements having outer surfaces lying in common planes with said tab ends.

7. A one-piece substantially rectangular nonmetallic dielectric clip for holding PCT devices, said clip having a substantially flat base with substantially flat front and rear faces, said base having an outer periphery defined by opposite sides and top and bottom ends that have a length shorter than said sides, said base having a base thickness between said front and rear faces, a bottom projection adjacent said bottom end and having opposite bottom projection sides spaced inwardly from said opposite sides of said base, said bottom projection having a thickness perpendicular to said front face that is substantially greater than said base thickness and having a bottom pocket therein adjacent said front face opening toward said top end of said base and limited by said bottom projection sides, said bottom pocket having a pocket bottom wall extending outwardly in a direction away from said front face of said base to intersection with a pocket forming wall that is spaced outwardly in a direction away from said front face and extends from said pocket bottom wall in a direction toward said top end of said base, and said bottom projection extending beyond said outer periphery from said bottom end in a direction away from said top end.

8. The clip of claim 7 wherein said bottom projection terminates at a bottom projection end and includes an end portion of gradually reducing thickness tapering toward said bottom projection end.

9. The clip of claim 7 wherein said bottom projection has a width in a direction between said opposite sides of said bottom projection that is not greater than one-half the width of said base between said opposite sides of said base.

10. The clip of claim 7 including a PTC device that includes a PTC material sandwiched between a pair of metal terminal plates, a pair of spaced-apart elongated terminals extending from said plates at one end of said PTC device, said PTC device being positioned on said front face of said base with said one end of said PTC device received in said pocket and with said terminals extending closely past said opposite bottom projection sides.

11. The clip of claim 10 wherein said terminal plates have corner portions adjacent said one end of said PTC device and said corner portions include tabs extending substantially perpendicular to said plates.

12. The clip of claim 10 wherein said terminals are integrated with said plates and said PTC device has a PTC device thickness, said terminals being deformed in a direction toward one another into laterally spaced-apart alignment with one another substantially along a centerline that substantially bisects said PTC device thickness.

13. The clip of claim 10 wherein said PTC device has a top end portion and said base of said clip includes a top pocket that opens downwardly toward said bottom pocket, and said top end portion of said PTC device being received in said top pocket.

14. The clip of claim 7 wherein said base has four corners and including spacer legs extending outwardly from said rear face adjacent each of said corners in the direction of said base thickness.

15. The clip of claim 7 including guide surfaces adjacent said opposite bottom projection sides for guiding electrical terminals on a PTC device, said guide surfaces being spaced outwardly from said front face of said base in the direction of said base thickness and extending substantially parallel to said front face.

16. The clip of claim 7 including peripheral walls extending outwardly of said front face in the direction of said base thickness along said opposite sides of said base and along portions of said top and bottom ends of said base.

17. The clip of claim 7 wherein said top end includes a central recess opposite said bottom projection and extending toward said bottom projection, said bottom projection having a width in a direction between said base sides and said recess having a width in the same direction that is at least as great as the width of said bottom projection.

18. The clip of claim 17 including guide projections extending outwardly from said top end on opposite sides of said recess for guiding electrical terminals on a PTC device, said guide projections having guide surfaces spaced outwardly from said front face of said base in the direction of said base thickness and extending substantially parallel to said front face.

19. The clip of claim 17 Wherein said guide projections have sloping surfaces on the opposite sides thereof from said guide surfaces, said guide projections having terminal ends and said sloping surfaces sloping in a direction to provide an increasing thickness for said guide projections from said guide projection terminal ends toward said base.

20. The clip of claim 7 including a pair of such clips reversely positioned end-for-end with said front faces thereof facing one another.

21. The clip of claim 20 wherein said bottom projection has a latch finger extending therefrom and a top end of one clip is latched beneath said latch finger on the other clip to latch the pair of clips together against movement away from one another.

22. The pair of clips of claim 21 and further including a PTC device received between said pair of clips and having electrical terminals extending outwardly from said pair of clips.

23. The clip of claim 7 including a top projection adjacent said top end of said base, said top projection having a top pocket adjacent said front face opening toward and aligned with said bottom pocket, said front face being substantially flat and unobstructed between said top and bottom pockets.

24. The clip of claim 7 including a substantially flat PTC device positioned against said front face and having an end portion received in said bottom pocket to prevent movement of said end portion of said PTC device away from said front face in the direction of said base thickness.

25. A circuit protector assembly comprising a PTC device that includes a PTC material sandwiched between a pair of metal terminal plates, a pair of spaced-apart elongated electrical terminals extending from said plates at one end of said PTC device, a one-piece substantially rectangular nonmetallic dielectric clip for holding said PTC device, said clip having a substantially flat base with top and bottom ends, opposite sides and front and rear faces, said base having a base thickness between said front and rear faces, a bottom projection adjacent said bottom end and having opposite bottom projection sides spaced inwardly from said opposite sides of said base, said bottom projection having a bottom pocket limited by said bottom projection sides and located adjacent said front face opening toward said top end of said base, said bottom pocket including a pocket forming wall spaced outwardly from said front face in the direction of said base thickness and extending in a direction toward said top end of said base, said PTC device being positioned on said front face of said base with said one end of said PTC device received in said pocket and with said electrical terminals extending closely past said opposite bottom projection sides beyond said bottom end of said base, said one end of said PTC device being trapped in said pocket between said front face and said pocket forming wall so that said pocket forming wall prevents movement of said one end of said PTC device away from said front face in the direction of said base thickness.

26. The clip of claim 25 wherein said terminal plates have corner portions adjacent said one end of said PTC device and said corner portions include tabs extending substantially perpendicular to said plates.

* * * * *